US006409359B1

(12) United States Patent
O'Connell

(10) Patent No.: US 6,409,359 B1
(45) Date of Patent: Jun. 25, 2002

(54) LIGHTED ROCK AND METHOD THEREFOR

(76) Inventor: Robert G. O'Connell, 10117 E. Morning Star Dr., Scottsdale, AZ (US) 85259

( * ) Notice: Subject to any disclaimer, the term of this patent is extended or adjusted under 35 U.S.C. 154(b) by 0 days.

(21) Appl. No.: 09/613,198

(22) Filed: Jul. 10, 2000

(51) Int. Cl.[7] ..... F21S 8/00

(52) U.S. Cl. ..... 362/145; 362/152; 362/762; 362/806; 362/812

(58) Field of Search ..... 362/145, 152, 362/276, 802, 806, 812, 362, 355; 40/568, 579, 580; D26/94; 52/102, 103, 104, 105

(56) References Cited

U.S. PATENT DOCUMENTS 4,229,894 A * 10/1980 Beck ..... 40/579
4,758,934 A * 7/1988 Von Kohorn ..... 362/806
5,211,469 A * 5/1993 Mattias et al. ..... 362/806
5,399,310 A * 3/1995 Payne et al. ..... 264/338
6,160,353 A * 12/2000 Mancuso ..... 315/159
6,161,496 A * 12/2000 Fulks ..... 114/357

* cited by examiner

*Primary Examiner*—Stephen Husar
*Assistant Examiner*—Guiyoung Lee
(74) *Attorney, Agent, or Firm*—Jeffrey Weiss; Harry M. Weiss; Weiss & Moy, P.C.

(57) ABSTRACT

An illuminated rock and method having the external appearance of a rock and having a light source inside which transmits light through openings in the rock to an outside viewer. Preferably, the light passes through a diffusion screen so as to obscure the actual light element from view, while allowing sufficient light to pass through the design. It is preferred that the design be in the form of a street number, with the illuminated rock being placed proximate a front portion of a home so that the street number may be viewed at night.

16 Claims, 1 Drawing Sheet

LIGHTED ROCK AND METHOD THEREFOR

FIELD OF THE INVENTION

This invention relates generally to outdoor decoration and, more specifically, to an artificial rock having a design drilled therethrough and having an illumination source therein so that the design may be viewed at night.

BACKGROUND OF THE INVENTION

For the convenience of visitors, for reasons of safety, and for related reasons, it is generally desirable that a building—particularly a residence—have its address prominently marked and visible. In the residential context, this is often achieved by painting the street address on the mail box, by painting the street address on the curb, or by placing wood or tile numbers on the exterior of the house.

One obvious problem with these methods is that they are generally not readily viewable at night. It is necessary therefore to provide a street address marking that is readily viewed at night. On the other hand, it is also generally desired that the apparatus displaying the street address be aesthetically pleasing. One way of providing an aesthetically pleasing apparatus is to provide one having the appearance of something that might generally be found in the front yard of a home.

Thus, a need existed for a device and method for providing a street address display that is both viewable at night but also aesthetically pleasing during daylight hours. A need further existed for a street address display having the appearance of an item that might generally be found in the front yard of a home. The present invention satisfies these needs and provides other, related, advantages.

SUMMARY OF THE INVENTION

An object of the present invention is to provide a street address display that is viewable at night.

A further object of the present invention is to provide a street address display that is viewable at night but also aesthetically pleasing during daylight hours.

A still further object of the present invention is to provide a street address display that is viewable at night but also aesthetically pleasing during daylight hours and that has the appearance of something that one may expect to find in a typical front yard of a residence.

BRIEF DESCRIPTION OF THE PREFERRED EMBODIMENTS

In accordance with one embodiment of the present invention, an illuminated artificial rock is disclosed. The illuminated artificial rock comprises, in combination: an artificial rock having an exterior surface and a hollow interior area; a design formed of a plurality of openings extending through the exterior surface and into the hollow interior area; and a light positioned within the hollow interior area and capable of transmitting light through the plurality of openings.

In accordance with another embodiment of the present invention, a method for providing an illuminated artificial rock is disclosed. The method comprises the steps of: providing an artificial rock having an exterior surface and a hollow interior area; providing a design formed of a plurality of openings extending through the exterior surface and into the hollow interior area; and positioning a light within the hollow interior area capable of transmitting light through the plurality of openings.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
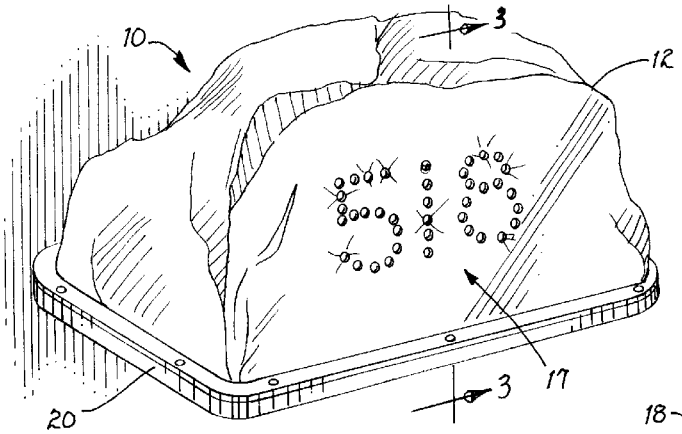
FIG. 1 is a perspective view of an illuminated artificial rock of the present invention.
Figure 3:
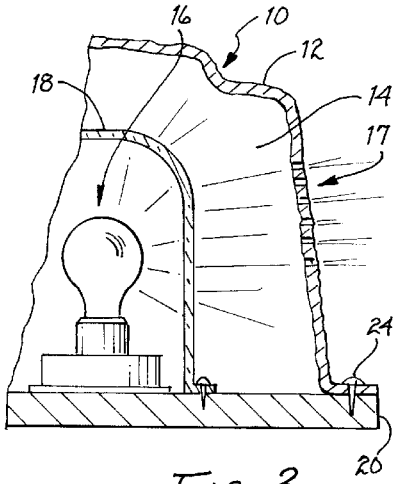
FIG. 3 is a cross-sectional view of the illuminated artificial rock of FIG. 1, taken along lines 3—3.
Figure 2:
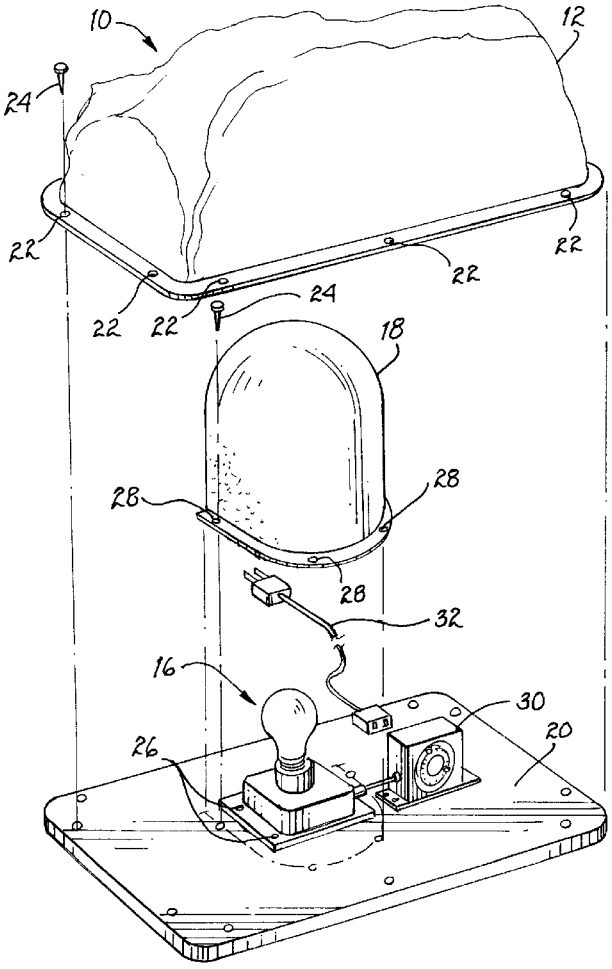
FIG. 2 is a perspective, exploded view of an illuminated artificial rock of the present invention.

Referring to FIGS. 1–3, the illuminated artificial rock 10 (the "illuminated rock 10") is shown. The illuminated rock 10 comprises at least the following components: a rock shell 12 having a hollow area 14 therein, a light source 16 located in the hollow area 14, and a design 17 through the rock shell 12 permitting light transmitted from the light source 16 to pass through the rock shell 12 and be visible to an outside observer. The light source 16 may be a low voltage light, of the type commonly used in landscaping. The light source 16 may, preferably, be colored so as to provide a more aesthetically pleasing design 17. As discussed below, the rock shell 12 should not only be shaped like a rock, but should also have coloring so as to give it a natural appearance, so as to increase the camouflage effect and to persuade a casual observer during daylight hours that the rock shell 12 is a genuine rock. The rock shell 12 should, preferably, be positioned proximate the front of a home so as to maximize exposure of the design 17.

As shown in FIGS. 2 and 3, the illuminated rock 10 further preferably includes a diffusion screen 18 positioned between the light source 16 and the design 17. The purpose of the diffusion screen 18 is to diffuse the light transmitted from the light source 16 so as to prevent an outside observer looking at the design 17 from seeing the bulb or other element comprising the light source 16. The diffusion screen 18 may be made from any material—e.g., plastic, glass, etc.—capable of diffusing light, sufficiently able to conceal the element comprising the light source 16, and yet sufficiently transparent to permit the desired amount of light to illuminate the design 17. The diffusion screen 18 may optionally be colored so as to alter or improve the visual appearance of the design 17.

As shown in FIGS. 1–3, the illuminated rock 10 further preferably comprises a base 20, over which the rock shell 12 (with the light source 16 positioned therein) may be placed. The base 20 may be made from wood, plastic, metal or virtually any reasonably durable material—though is preferably made from a material having at least some resistance to harm caused by being positioned outdoors on the ground, including harm caused by moisture, insects, etc. The rock shell 12 may simply be placed on top of the base 20, with the weight of the rock shell 12 maintaining it in position, or it may be secured through openings 22 about the perimeter of the rock shell 12 using screws 24 as shown in FIGS. 2 and 3. Similarly, the light source 16 may be positioned on the base 20 without the benefit of any additional hardware, or may be secured to the base 20 with screws (not shown)

through openings 26 in the base of the light source 16. Still further, the diffusion screen 18 may, optionally, be secured to the base 20 with screws 24 through openings 28 in the base of the diffusion screen—or may be positioned between the light source 16 and design 17 in any one of a variety of other ways.

Referring specifically to FIG. 2, preferably the illuminated rock 10 further includes a mechanism for automatically turning the light source 16 on and off at the desired times. One such mechanism is an electric timer 30, into which the light source 16 may be coupled and which electric timer 30 may then be attached to a power source (not shown) with chord 32. Other mechanisms for automatically turning the light source 16 on and off would be possible, including the use of a light sensor capable of detecting when the ambient light falls below a certain level—at which point the light source 16 would be activated—and then deactivating the light source 16 when the ambient light falls above a certain level. Such light detectors are well known in the art.

Figure 4:
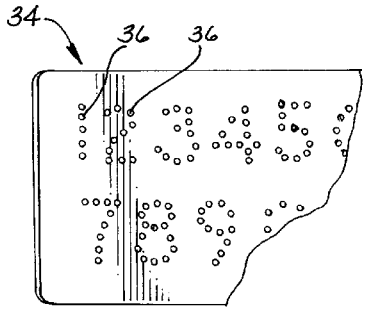
FIG. 4 is a front view of a stencil having numbers and useable for placing a street address on an illuminated artificial rock of the present invention.

Referring now to FIGS. 1 and 4, the design 17 in its street number embodiment is discussed. In this regard, the design 17 could be any desired, aesthetically pleasing design—such as a name, one or more letters, one or more numbers, a shape, or any combination thereof—and is not necessarily limited to a street number. However, in the preferred embodiment, the design 17 is a street number. The design 17 in its street number embodiment or otherwise is preferably formed by drilling a series of holes all the way through exterior surface of the rock shell 12, so as to permit light to pass from the light source 16 through the rock shell 12 where it can be viewed by an outside observer.

Preferably, this drilling is accomplished by the use of a stencil 34, preferably having thereon numbers 36 (ranging from 0 to 9), each of which is formed by a series of holes as shown in FIG. 4. (While the stencil 34 preferably has a plurality of numbers 36, it would be possible to have a series of individual stencils 34, each having only a single number 36—one each for numbers 0 through 9.) In this regard, the stencil 34 may be taped to the rock shell 12 in the position desired for placement of the design 17. The numbers 36 may then be traced onto the rock shell 12 through the stencil 34, for example using a washable marker. The stencil 34 may then be removed, and the tracing followed by making a series of holes with an electric drill, with any excess marker to be wiped away. Assuming the rock shell 12 is formed of boat resin or like material, a steel bit is preferably used, with a 5/32" size preferred.

While the use of a stencil 34 in the manner described above is preferred in the creation of the design 17, the design 17 may be created in any desired way. For example, a large space could be cut into the rock shell 12, into which could be inserted and secured a plate or dark plastic piece having a street number or other design drilled thereon.

The steps of creating the rock shell 12 are preferably as follows:

1. A mold is first formed, preferably from fiberglass, in the shape of a rock having an open bottom. In forming the mold and in the interest of creating greater realism, real rocks may used, with the fiberglass being formed over the real rocks.
2. The mold is inverted so that the open bottom is facing upward. The inside surface of the mold is coated with a Johnson paste wax or an aerosol release agent, to allow the finished rock shell 12 to be readily removed from the mold and to provide a sticky base for the colors (discussed below) to adhere.
3. Coloring, preferably in the form of powdered cement colors, is lightly sprinkled into the mold, taking care to try to cover as much of the surface of the mold as possible. A small brush may be used to assist in the proper distribution of the coloring. Where a brown color is desired, brown, yellow and black powdered cement colors should be used in combination. Where a gray color is desired, gray, yellow and black powdered cement colors should be used in combination.
4. The material to form the rock shell 12 is created and used to line the mold over the coloring. Preferably, the material used is a composition of boat resin, a catalyst, high fiber powder, and a small amount of liquid white color pigment. This composition should be mixed to a paste-like consistency.
5. A single coating of the boat resin composition should be applied to the entire interior of the mold over the coloring, using either a paint brush or a sprayer with a large nozzle opening.
6. Fiberglass matting should be cut into pieces, preferably about eight inches in length, and used to cover the coating of the boat resin composition.
7. The fiberglass matting layer should be covered with a second coating of the boat resin composition.
8. The layers of boat resin material should be allowed to set up, preferably for about 30 to 45 minutes. When the material pulls easily away from the mold and slightly snaps back, it is ready to be removed. After removal, the rock shell 12 should be allowed to harden on a flat surface, preferably for approximately four to six hours.

While these represent the preferred steps for creating the rock shell 12, essentially any method resulting in an artificial rock shell 12 would be within the spirit or scope of the present invention.

While the invention has been particularly shown and described with reference to preferred embodiments thereof, it will be understood by those skilled in the art that the foregoing and other changes in form and details may be made therein without departing from the spirit and scope of the invention.

I claim:

1. An illuminated artificial rock comprising, in combination:

an artificial rock having an exterior surface and a hollow interior area;

a street number formed of a plurality of openings extending through a front portion of said exterior surface and into said hollow interior area; and a light positioned within said hollow interior area and oriented to transmit light toward said front portion of said exterior surface and through said plurality of openings so as to illuminate said street number and thus cause said street number to be visible to a person positioned opposite said front portion of said exterior surface.

2. The illuminated artificial rock of claim 1 wherein said artificial rock is comprised of fiberglass.

3. The illuminated artificial rock of claim 1 further comprising a diffusion screen positioned between said light and said plurality of openings.

4. The illuminated artificial rock of claim 1 further comprising means for automatically turning said light on and off.

5. The illuminated artificial rock of claim 4 wherein said means comprises a timer.

6. The illuminated artificial rock of claim 1 further comprising a base positioned below said light and said artificial rock and dimensioned to cover a bottom portion of said hollow interior area.

7. The illuminated artificial rock of claim 1 wherein said light is colored.

8. A method for providing an illuminated artificial rock comprising the steps of:

providing an artificial rock having an exterior surface and a hollow interior area;

providing a street number formed of a plurality of openings extending through a front portion of said exterior surface and into said hollow interior area; and positioning a light within said hollow interior area and orienting said light to transmit light toward said front portion of said exterior surface and through said plurality of openings so as to illuminate said street number and thus cause said street number to be visible to a person positioned opposite said front portion of said exterior surface.

9. The method of claim 8 wherein said step of providing an artificial rock further comprises the steps of:

providing a mold in the shape of a rock;

coating an inside surface of said mold with a release agent;

applying to said inside surface over said release agent colors;

applying a first layer of boat resin over said release agent colors;

applying a layer of fiberglass matting material to said layer of said boat resin;

applying a second layer of said boat resin over said layer of fiberglass matting material;

allowing said first layer and said second layer to set up and to thereby form said artificial rock; and removing said artificial rock from said mold.

10. The method of claim 9 wherein said release agent is wax.

11. The method of claim 9 wherein said colors comprise at least one cement color.

12. The method of claim 8 wherein said step of providing said design further comprises the steps of:

providing a stencil having at least one number thereon;

positioning said stencil upon an exterior surface of said artificial rock; and drilling openings in said exterior surface of said artificial rock corresponding to openings on said stencil.

13. The method of claim 8 further comprising the step of providing a diffusion screen positioned between said light and said plurality of openings.

14. The method of claim 8 further comprising the step of providing means for automatically turning said light on and off.

15. The method of claim 14 wherein said means comprises a timer.

16. The method of claim 8 further comprising the step of providing a base positioned below said light and said artificial rock and dimensioned to cover a bottom portion of said hollow interior area.

* * * * *